United States Patent [19]

Ciraud

[11] Patent Number: 4,532,882

[45] Date of Patent: Aug. 6, 1985

[54] MACHINE FOR SPREADING AND SMOOTHING SURFACE COVERINGS

[76] Inventor: Pierre H. Ciraud, 23, rue d'Isly, 16100 Cognac, France

[21] Appl. No.: 425,399

[22] Filed: Sep. 28, 1982

[30] Foreign Application Priority Data

Oct. 15, 1981 [FR] France ..... 81 19563

[51] Int. Cl.[3] ..... B05C 11/04

[52] U.S. Cl. ..... 118/108; 118/305; 118/415

[58] Field of Search ..... 118/415, 108, 305, 413

[56] References Cited

U.S. PATENT DOCUMENTS

| | | | |
|---|---|---|---|
| 2,303,120 | 11/1942 | Greaves-Walker | 118/415 X |
| 3,305,887 | 2/1967 | Turner | 118/108 X |
| 3,804,696 | 4/1974 | Lobmeier | 118/108 X |

*Primary Examiner*—John P. McIntosh
*Attorney, Agent, or Firm*—Robert J. Koch

[57] ABSTRACT

A machine for spreading and smoothing surface coverings comprises a frame mounted on wheels of which one is steerable, a hopper for storing and dispensing the covering material, bladed members for mixing the covering material, a chute for discharging the covering material at the lower end of the hopper and a valve member for adjusting the flow of the covering material. A spreading blade and a smoothing blade are disposed transversely of the direction of displacement of the machine, the spreading blade facing the discharge end of the chute and the smoothing blade being arranged behind the spreading blade, the blades comprising strips of flexible material such a rubber bearing on the ground. A linkage is provided for raising and lowering the blades.

2 Claims, 7 Drawing Figures

MACHINE FOR SPREADING AND SMOOTHING SURFACE COVERINGS

FIELD OF THE INVENTION

The present invention relates to a machine for spreading and smoothing any kind of surface covering on the ground, for example, a surface covering containing a bituminous mixture with a synthetic resin for providing courts for sports such as tennis or basketball.

The laying of this type of surface covering poses certain types of problems owing to the need to work quickly and have a resulting surface which is as smooth, uniform and flat as possible.

Up to now the customary technique has been rather rudimentary since it involves spreading and smoothing the surface covering material with a horizontal straight edge secured to the end of a long handle and manipulated like a broom.

This type of surface covering which contains silicone or neoprene, for example, has the drawback of polymerizing quickly which means that a number of workers are needed at the same time for a given surface covering or a single worker must work under extenuating conditions if an excellent surface finish is to be obtaned. In either event such a method is impractical and relatively expensive.

OBJECT AND SUMMARY OF THE INVENTION

An object of the invention is to overcome the foregoing drawbacks of this rudimentary technique by providing a machine for spreading and smoothing all types of covering materials and particular covering materials for playing courts or the like, which machine permits the surface covering to be spread and smoothed with reduced effort and in less time.

According to the invention there is provided a machine for spreading and smoothing surface coverings such as those containing synthetic resins, in particular for playing courts, the machine comprising a frame mounted on wheels, of which at least one is a steerable, a hopper for storing and distributing the covering material is mounted on the frame, means for mixing and blending the covering material is also mounted on the frame. A chute for discharging the covering material is mounted at the lower end of the hopper, and means adjusting the flow of the covering material into the chute. The machine also comprises a first blade for spreading covering material discharged from the chute and a second blade for smoothing material spread by the spreading blade. The blades are disposed transversely of the direction of displacement of the frame, the spreading blade being arranged facing the discharge end of the chute and the smoothing blade being arranged behind the spreading blade relative to the direction of displacement of the machine, the blades being made of strips of flexible material bearing on the ground under the force of gravity, and means are provided for raising and lowering the spreading and smoothing blades.

According to an embodiment, the general planes of the strips of flexible material in line with their zones of securement are inclined upwardly and forwardly relative to the direction of displacement of the machine, and the free edges of the strips lie tangent to the ground. Also, the end of the strips of flexible material are horn-shaped and concave in the direction of displacement of the machine. Further, the strips of flexible material have in their central portions constant maximum slopes, the slopes of the strips of flexible material diminishing toward the extremities of their respective horn-shaped ends.

With a single pass of such a machine the surface covering may be quickly and easily spread and smoothed. A single operator is necessary for loading the machine, pulling or pushing it for displacement, and steering it.

These and other features and advantages of the invention will become apparent from the following description given by way of example only, with reference to the accompanying drawings.

DESCRIPTION OF THE PREFERRED EMBODIMENT

Figure 1:
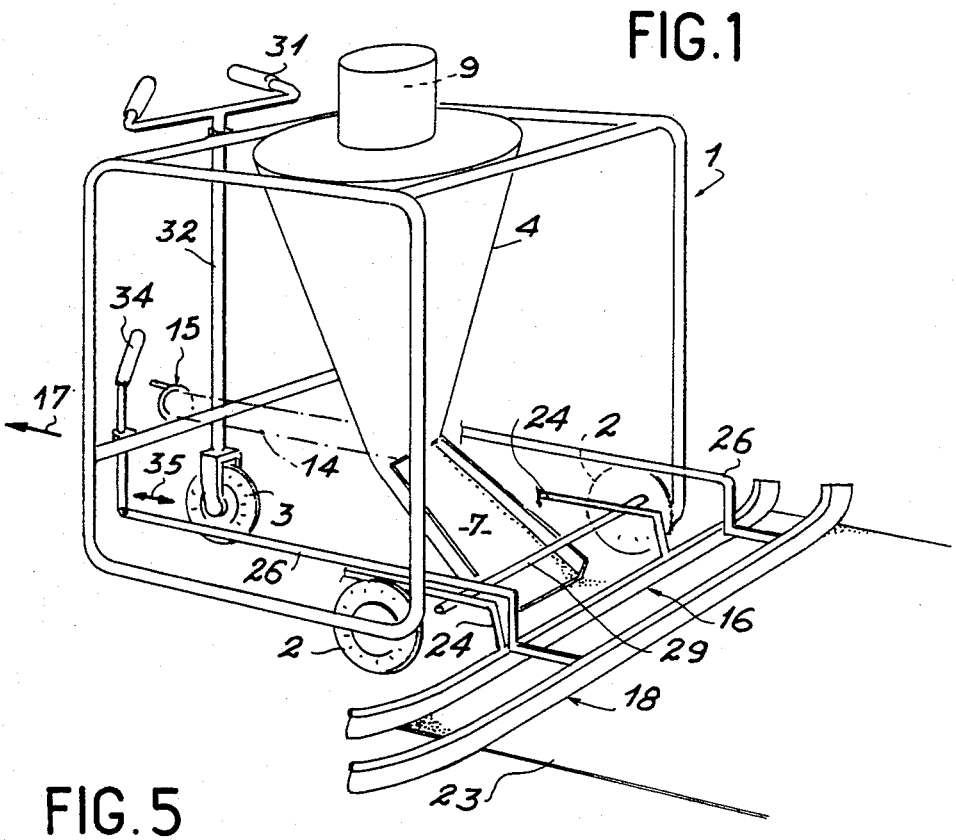
FIG. 1 shows a diagrammatic perspective view of a machine embodying the invention.

As shown in the drawings the frame 1 is made of angle members and is generally of boxlike configuration. The frame 1 is carried on two rear, nonsteering wheels 2 and one front, steering wheel 3, relative to the direction of displacement of the machine in operation.

Inside the boxlike cage defined by the angle members of the frame 1 is vertically fixed a hopper 4 for storing and dispensing the surface covering material. The hopper 4 is a downwardly tapering frustoconical container having a discharge opening 5 which is adapted to be closed or open by a slide valve member 6 for adjusting the discharge flow of covering material. The discharge opening 5 opens downwardly into a chute 7 rearwardly downwardly inclined to the ground.

A drive shaft 8 lies along the axis of the hopper 4 and is driven by a motor or engine, schematically shown at 9, carried by the frame 1. The shaft 8 drives a first bladed member 10 at the bottom of the hopper 4 and a second bladed member 11 provided with an annular deflector 12 for protection against splattering the covering material. The two bladed members 10 and 11 are provided for mixing and blending the covering material.

A part frustoconical screen basket 13 is removably mounted at the inlet opening of the hopper 4 for receiving covering material charging the hopper 4.

Figure 2:
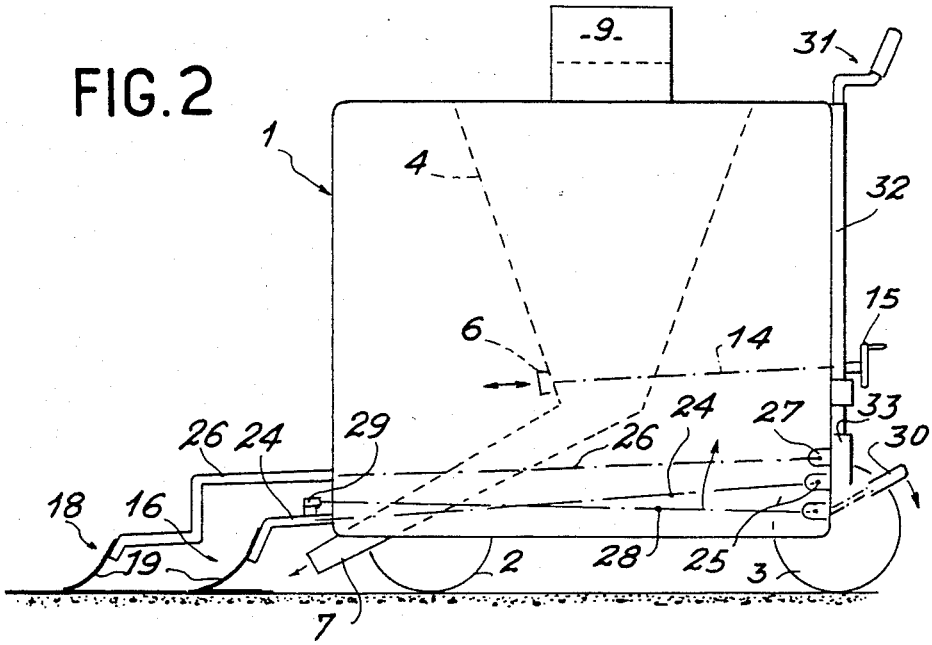
FIG. 2 shows a side elevational view of the machine in the FIG. 1.
Figure 3:
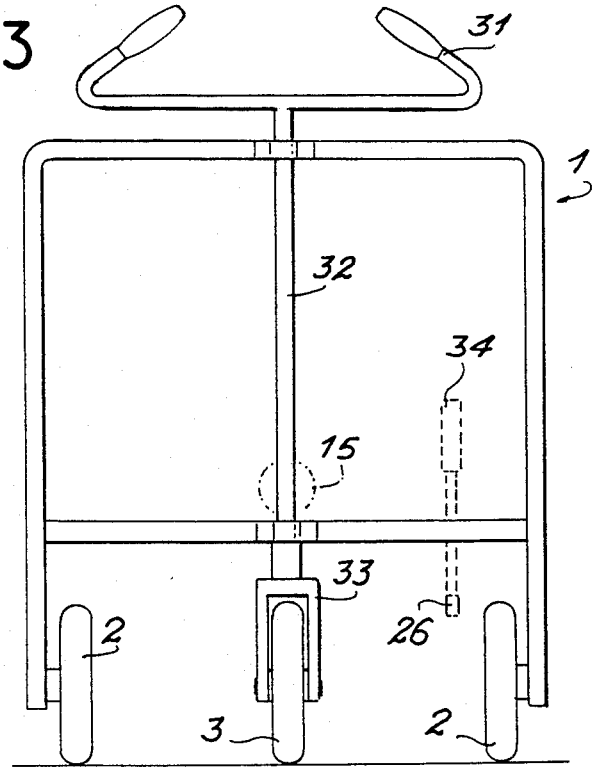
FIG. 3 shows a front end view of the machine of FIGS. 1 and 2.
Figure 4:
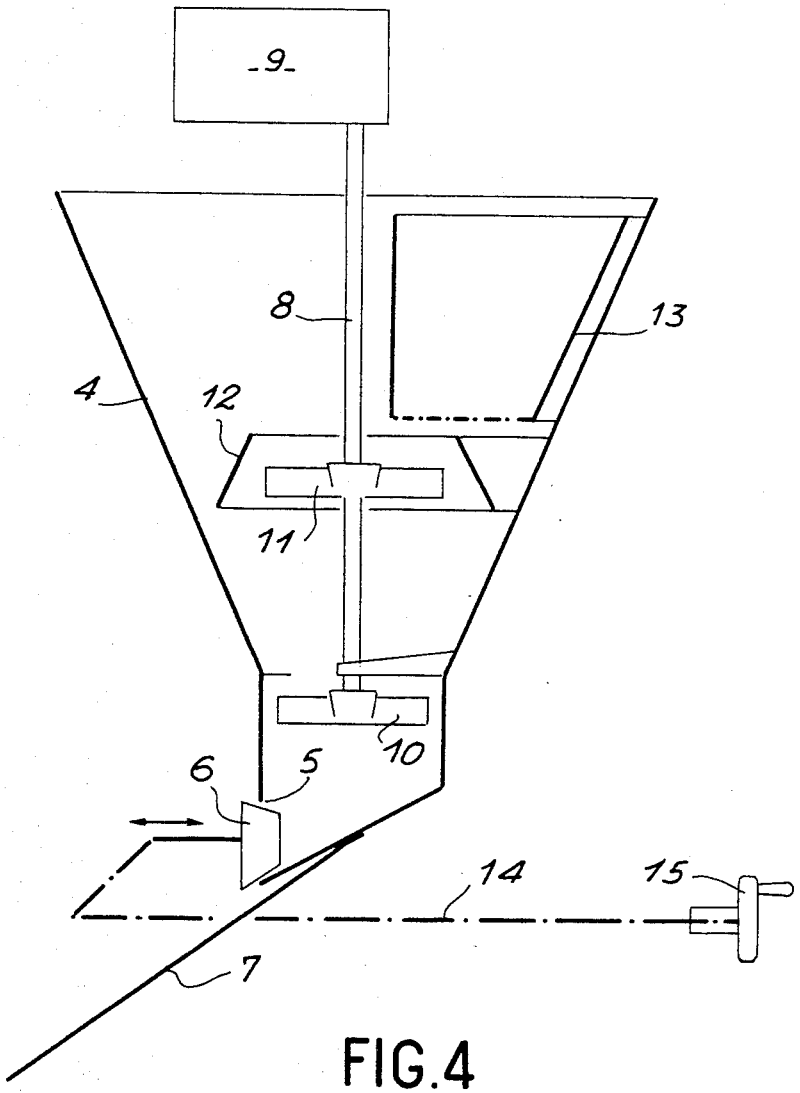
FIG. 4 shows a diagrammatic vertical cross sectional view through the covering material mixing and dispensing system of the machine.

The position of the slide valve member 6 relative to the discharge opening 5 is adjustable by means of a linkage schematically illustrated by a chain dotted line at 14 and controlled, for example, by a handwheel or crank 15 at the front of the frame (FIG. 2).

The covering material is discharged onto the ground at the lower end of the chute 7 immediately in front of a first spreading blade 16 disposed transversely relative to the direction of displacement (arrow 17) of machine.

The machine also has a second, smoothing blade disposed behind the spreading blade 16 parallel to the latter.

Figure 7:
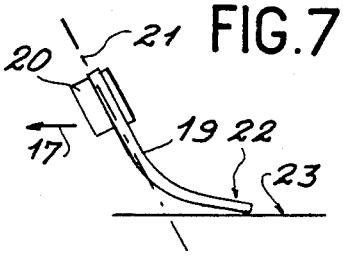
FIG. 7 shows another transverse sectional view through the middle portion of the spreading blade taken on line VII—VII in FIG. 5.

Each blade is made of a strip 19 of flexible material such a rubber, fixed along its upper edge by a supporting and holding rod or angle member 20 (FIG. 7).

Figure 6:
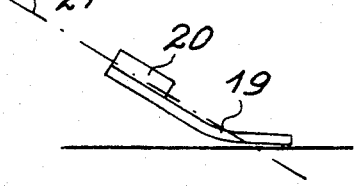
FIG. 6 shows a transverse sectional view through the spreading blade taken on line VI—VI in FIG. 5.

The middle portions of the blades 16 and 18 which run at least the full width of the machine are straight and their respective ends are horn-shaped and concave in the direction of displacement of the machine. In the general plane 21 of the straight middle portions of the flexible strips 19 (FIG. 7) are in line with the supporting and holding member 20 and slope upwardly and forwardly relative to the direction of displacement of the machine. The free lower edges 22 of the strips 19 are tangent to the ground or more specifically the upper surface of the layer 23 of covering material. On the other hand the slopes of the general planes 21 of the concave portions of the strips 19 diminish as illustrated in FIG. 6, reaching a minimum of several degrees at their extremities where the strips are nearly flat in contact with the ground. The general planes 21 may, optionnally, be adjustable.

The spreading blade 16 is movably mounted at the ends of two levers 24 pivoted at 25 (FIG. 2) on the frame 1. On the other hand, the smoothing blade 18 is also movably mounted at the ends of two levers 26 pivotally mounted at 27 on the frame 1.

Blades 16 and 18 bear under their own weight against the ground through the intermediary of their flexible strips 19 and may be raised for changing the direction of the machine, e.g. turning it around, by means of a lifting mechanism 28 operating levers 24 and 26 through a transverse horizontal bar 29 and controlled by a foot pedal schematically shown at 30 and pivotally mounted on the frame 1.

Finally, the steering and direction of the machine are controlled by handlebars 31 arranged at the front on the upper part of the frame 1 and through a vertical shaft 32 and a yoke 33 carrying the steering wheel 3.

The operation of the machine will now be described.

The covering material, for example, for a tennis court, containing a synthetic resin and a charge such as silica, is poured into the screen basket 13. The hopper 4 may be more or less filled, the covering material being mixed and blended constantly by the bladed members 10 and 11 driven by the motor or engine 9 e.g., an internal combustion engine.

The machine is pulled by the handlebars at the desired speed, e.g. at a pace according to the nature, viscosity and flow rate of the covering material and the desired thickness of the layer 23 of covering material. The flow rate of the covering material into the chute 7 is easily adjusted by the handwheel or crank 15 adjusting the position of the slide valve member 6.

The first blade 16 spreads the covering material discharged from the chute 7 and the second blade 18 smooths the layer formed by the first blade 16.

Due to the shape and the arrangement of the blades 19 which are freely hanging like pendulum one's obtains a layer 23 having a perfect flatness as well as a perfect surface regularity.

At the end of a pass of the machine, the valve member 6 is operated to stop the discharge of the covering material, and blades 16,18 are raised by the action of pedal 30 to turn the machine around with the handlebars 31 and position the machine alongside the strip which has just been laid to effect a pass in the opposite direction.

Figure 5:
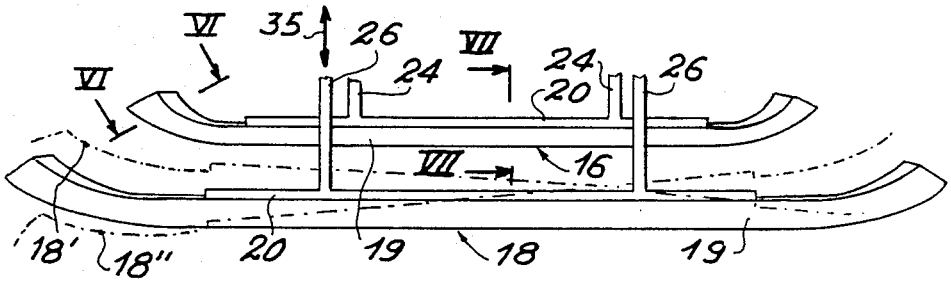
FIG. 5 shows a top plan view of the spreading and smoothing blades of the machine.

Thus in a matter of a few minutes it is possible to lay a tennis court whereas it took much more time with the rudimentary technique described above. Moreover when an inclined surface is to be covered the smoothing blade 18 may be moved closer or farther away from the spreading blade (FIG. 5) by means of a handle 34 for moving one of the levers 26 (in the direction of arrow 35) while the other lever 26 remains stationary. By moving the blade 18 to the position 18' closer to blade 16 or by moving blade 18 to position 18" farther from blade 16 it is possible to correct for the effects of gravity on the covering material driving the same to one side of the machine by forming an acute angle between the blades 16,18 on the side where the covering material has the tendency to accumulate.

Of course, the invention is not intended to be limited to the illustrated and described embodiment but on the contrary is intended to cover all modifications and alternatives understood to those skilled in the art without departing from the spirit and scope of the invention. In particular it would be possible to modify the structure, configuration and arrangement of the spreading and smoothing blades as well as the means for adjusting and controlling the supply of the covering material and the means for guiding and displacing the machine. Moreover, it would be possible to motorize the machine in which case it would be self-propelled and not drawn or pushed. Finally, the operating levers 24 and 26 may be provided with counterweights for modifying the bearing force of the blades 16,18 on the ground.

What is claimed is:

1. A machine for spreading and smoothing surface coverings such as those containing synthetic resins, comprising:

(a) a frame mounted on wheels, at least one of said wheels being steerable;

(b) a hopper for storing and dispensing surface covering material and being mounted on said frame;

(c) means for mixing and blending the surface covering material in said hopper;

(d) a chute for discharging the surface covering material from said hopper and mounted at the lower end of said hopper;

(e) means for adjusting the flow of said surface covering material into said chute;

(f) a spreading blade for spreading surface covering material discharged from said chute and a smoothing blade for smoothing surface covering material spread by said spreading blade, (g) means for raising and lowering said spreading and smoothing blades, said spreading and smoothing blades being disposed transversely to the direction of displacement of said machine, said spreading blade being arranged facing the discharge end of said chute and said smoothing blade being arranged behind said spreading blade relative to the direction of displacement of said machine, said blades comprising strips of flexible material bearing on the ground, the general plane (21) of the straight middle portions of said flexible strips, on a level with the supporting means (20), being sloped upwardly and forwardly relative to the direction of displacement of the machine while said plane has a constant and maximal slope in the middle portion of said strips and has a diminishing slope toward the extremities of said strips, and the free edge of said strips lying tangentially to the ground.

2. The machine of claim 1 wherein said smoothing blade is skewable relative to said spreading blade so as to define an acute angle therebetween to either side of said machine depending on the inclination of the ground.

* * * * *